US011994329B2

(12) United States Patent
Saito et al.

(10) Patent No.: US 11,994,329 B2
(45) Date of Patent: May 28, 2024

(54) ICE MAKING DEVICE

(71) Applicant: NIDEC SANKYO CORPORATION, Nagano (JP)

(72) Inventors: Shunji Saito, Nagano (JP); Satoshi Tanimura, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 330 days.

(21) Appl. No.: 17/436,586

(22) PCT Filed: Feb. 19, 2020

(86) PCT No.: PCT/JP2020/006461
§ 371 (c)(1),
(2) Date: Sep. 3, 2021

(87) PCT Pub. No.: WO2020/179445
PCT Pub. Date: Sep. 10, 2020

(65) Prior Publication Data

US 2022/0170681 A1 Jun. 2, 2022

(30) Foreign Application Priority Data

Mar. 6, 2019 (JP) ..... 2019-040443

(51) Int. Cl.
*F25C 1/04* (2018.01)
*F25C 1/22* (2018.01)

(52) U.S. Cl.
CPC ..... *F25C 1/04* (2013.01); *F25C 1/22* (2013.01); *F25C 2400/10* (2013.01); *F25C 2600/04* (2013.01); *F25C 2700/12* (2013.01)

(58) Field of Classification Search
CPC ..... F25C 5/06; F25C 1/04; F25C 2400/10; F25C 2600/04; F25C 2700/12; F25C 1/22–1/25; F25D 17/06–17/067
See application file for complete search history.

(56) References Cited

U.S. PATENT DOCUMENTS 6,438,988 B1 * 8/2002 Paskey ..... F25C 1/04 62/353
8,499,571 B2 8/2013 Saito
(Continued)

FOREIGN PATENT DOCUMENTS

JP S5454960 U 4/1979
JP S56110861 A 9/1981
(Continued)

OTHER PUBLICATIONS

International Search Report in PCT/JP2020/006461, dated Mar. 31, 2020. 6pp.

*Primary Examiner* — Cassey D Bauer
(74) *Attorney, Agent, or Firm* — HAUPTMAN HAM, LLP

(57) ABSTRACT

Provided is an ice-making device that can autonomously perform a series of ice-making operations that include control of a fan motor, without relying on a higher-level device. An ice-making device that is characterized by comprising an ice-making tray, a fan motor that blows air onto the ice-making tray, an ice removal mechanism that removes ice from the ice-making tray, a control part, and a frame that holds the ice-making tray, the fan motor, the ice removal mechanism, and the control part. The ice-making device is also characterized in that the control part controls the operations of the fan motor, the ice removal mechanism, and a water supply mechanism that opens/closes a water supply path that supplies water to the ice-making tray.

19 Claims, 6 Drawing Sheets

(56) References Cited

U.S. PATENT DOCUMENTS

| | | | | |
|---|---|---|---|---|
| 2012/0247130 | A1* | 10/2012 | Ito | F25C 1/04 62/126 |
| 2015/0362242 | A1* | 12/2015 | Bauriedl | F25C 1/04 62/340 |
| 2019/0011160 | A1 | 1/2019 | Bertolini et al. | |

FOREIGN PATENT DOCUMENTS

| | | | | |
|---|---|---|---|---|
| JP | H526548 | A | 2/1993 | |
| JP | 2007187412 | A | 7/2007 | |
| JP | 2017161086 | A | 9/2017 | |
| WO | WO2004/036127 | * | 4/2004 | F25C 1/04 |

* cited by examiner

ICE MAKING DEVICE

RELATED APPLICATIONS

The present application is National Phase of International Application Number PCT/JP2020/006461, filed Feb. 19, 2020, and claims priority based on Japanese Patent Application No. 2019-040443, filed Mar. 6, 2019.

TECHNICAL FIELD

The present invention relates to an automatic ice making technique and specifically relates to an ice making device on which a cooling fan is mounted.

BACKGROUND ART

In the following Patent Literature 1, an ice making device is disclosed which includes a fan motor for sending air to an ice tray. The ice making device described in Patent Literature 1 is structured so that an upper face of a frame which supports an ice tray is provided with an opening in a frame shape, and a fan motor is fixed to an upper face of the frame so as to straddle the opening.

The ice making device described in Patent Literature 1 includes a drive part structured to turn the ice tray, and a control part for the fan motor is mounted in the drive part. The control part for the fan motor receives a signal indicating completion of water supply to the ice tray and starts driving of the fan motor and, when temperature of the ice tray reaches a predetermined temperature, the fan motor is stopped.

CITATION LIST

Patent Literature

[PTL 1] Japanese Patent Laid-Open No. 2017-161086

SUMMARY OF THE INVENTION

Problems To Be Solved by the Invention

Commonly, an operation of the ice making device disposed in a freezer chamber is controlled by a refrigerator-freezer which is a host apparatus. On the other hand, there is also a need for an ice making device which is capable of performing a series of operations from water supply to ice separation independently from a host apparatus. However, there are few ice making devices capable of coping with such a need under the present circumstances.

In view of the problem described above, an objective of the present invention is to provide an ice making device which is capable of autonomously performing a series of ice making operations including control for a fan motor independently from a host apparatus.

Means to Solve the Problems

To solve the above-mentioned problem, the present invention provides an ice making device including an ice tray, a fan motor structured to send air to the ice tray, an ice separating mechanism which is a mechanism structured to take out ice pieces from the ice tray, a control part, and a frame which is a frame body holding the ice tray, the fan motor, the ice separating mechanism and the control part. The control part controls operations of the fan motor, the ice separating mechanism, and a water supply mechanism which is a mechanism structured to open and close a water supply passage for supplying water to the ice tray.

The control part is mounted in the ice making device, and the control part is capable of controlling operations of the ice separating mechanism, the fan motor and the water supply mechanism. Therefore, a series of operations from water supply to ice separation can be performed independently from a host apparatus.

Further, in the ice making device in accordance with the present invention, it is preferable that the ice making device further includes a temperature sensor which acquires temperature of the ice tray, and the control part controls the operations of the ice separating mechanism and the fan motor based on a detection value of the temperature sensor. For example, instead of performing a series of ice making operations with a time period as a reference, respective mechanisms are controlled while measuring actual temperature of the ice tray by a temperature sensor and thus, ice pieces with a high degree of quality can be produced more efficiently and stably.

Further, in the present invention, it is preferable that the control part drives the fan motor until the temperature of the ice tray becomes a predetermined temperature equal to or lower than 0° after water has been supplied to the ice tray, and the predetermined temperature is the same or higher than temperature at which driving of the ice separating mechanism is started. After the water has been supplied, heat transfer of the water which is supplied to the ice tray is mainly performed during a time when the water temperature becomes about 0° in which a state of the water is changed into ice. The fan motor is driven only during a time when air flowed by the fan motor is effective and thus, while an ice-making capacity is maintained, power saving of the ice making device can be attained.

Further, in the present invention, it is preferable that the ice separating mechanism includes a drive unit which is a drive part for the ice separating mechanism, and the control part is disposed in an inside of a case of the drive unit. A case of the drive unit is utilized for protecting the control part and thus, in comparison with a structure that a case body accommodating the control part is separately prepared, a structure of the entire ice making device can be simplified.

Further, in the present invention, it is preferable that the drive unit is structured to turn the ice tray so as to be reversed, and the frame is provided with a block part which is contacted with a part of the ice tray during turning of the ice tray to partially disturb the turning of the ice tray. A twisting type of an ice separating mechanism whose structure is simple in comparison with a scraping-out type of an ice separating mechanism is adopted and thus, a manufacturing cost of the ice making device can be suppressed.

Further, in the present invention, it is preferable that the fan motor is fixed to only a first frame part which is one of a plurality of frame parts structuring respective sides surrounding a periphery of the ice tray in a plan view of the frame. When a part of the ice tray is pressed against the block part of the frame, the frame which is a frame body is deformed so that its outer shape is twisted. In this case, when the fan motor is fixed to a plurality of the frame parts structuring the frame, displacement directions and displacing amounts of the frame parts are different from each other and thus, a fixing face of the fan motor is distorted. In the ice making device in the present invention, the fan motor is fixed to only one frame part structuring the frame and thus, distortion of a fixing face of the fan motor is suppressed to be small, and looseness and damage of a fixing part of the fan motor are restrained.

Further, in the present invention, it is preferable that the frame is provided with an attaching part structured to fix the ice making device in an inside of a freezer chamber, and the attaching part is provided in the first frame part. When the attaching part is immovably fixed to an inside of a freezer chamber, deformation of the first frame part is restricted by the attaching part. As a result, distortion of the fixing face of the fan motor is suppressed to be small.

In this case, it is preferable that the first frame part is provided with a plurality of the attaching parts, and the fan motor is fixed between one of the attaching parts and another of the attaching parts provided in the first frame part. In a portion between the two attaching parts of the first frame part, transmission of distortion is blocked by the attaching parts and thus, the deforming amount is especially small. As a result, distortion of the fixing face of the fan motor is further suppressed to be small.

Further, in the ice making device in accordance with the present invention, it is preferable that an outer peripheral shape of the frame in a plan view is substantially rectangular, and the first frame part structures one of long sides of the frame in the plan view. One of long sides which are easily deformed compared to a short side is fixed by using the attaching part and thus, a deforming amount of the entire frame can be reduced.

Further, in the present invention, it is preferable that the frame is provided with a second frame part which is a frame part of the plurality of the frame parts facing the first frame part with the ice tray interposed therebetween, and a rotation center of the fan motor is located at a position which is shifted to the first frame part side with respect to a center position between the first frame part and the second frame part in the plan view of the frame. For example, in a case that the attaching part of the first frame part is fixed to a wall face of a freezer chamber or, in a case that an air passage on the first frame part side is formed in a bottle neck shape due to a shape of the first frame part, air of the fan motor is stagnant on the first frame part side and air pressure in the vicinity of the first frame part becomes higher than those of other portions and thereby, the air of the fan motor is hard to flow to the first frame part side. Therefore, when the fan motor is previously disposed at a position shifted to the first plate part side and an air passage is set so that air of the fan motor flows from the first plate part side to the other side, stagnation of air on the first plate part side is prevented and heat of solidification can be smoothly released.

In this case, it is preferable that the second frame part is a plate-shaped frame part, and the second frame part is provided with a cut-out part through which air from the fan motor is capable of flowing in a horizontal direction. When a cut-out part is provided in the second frame part, air of the fan motor is capable of further smoothly flowing from the first frame part side to the second frame part side.

Further, in the present invention, it is preferable that the first frame part is provided with a pedestal part which is a portion formed so that its thickness in an upper and lower direction is larger than another portion, and the fan motor is fixed to the pedestal part. The thickness of the fixing face of the fan motor is formed thick so that rigidity of the portion is increased and, as a result, even when the first plate part is deformed, distortion of the fixing face of the fan motor is suppressed to be small.

Further, in the ice making device in accordance with the present invention, it is preferable that the ice tray is made of resin, and the fan motor sends air to the ice tray from an upper side with respect to the ice tray. Different from an ice tray made of metal, the ice tray made of resin acts like heat insulating material and thus, it is inefficient to blow air of the fan motor toward the ice tray from an under side with respect to the ice tray. When air is blown to the ice tray from an upper side with respect to the ice tray, in other words, when air of the fan motor is directly blown to water in the ice tray, heat of solidification can be smoothly released from the water in the ice tray.

Further, in the present invention, it is preferable that an outer peripheral shape of the fan motor is substantially square in a plan view, and only an end part structuring one side of the fan motor is fixed to the first frame part in the plan view of the fan motor.

Effects of the Invention

As described above, according to the ice making device in the present invention, a series of ice making operations including control for a fan motor is capable of autonomously performing independently from a host apparatus.

DESCRIPTION OF EMBODIMENTS

An embodiment of an ice making device in accordance with the present invention will be described below with reference to the accompanying drawings. An ice making device "U" which will be described below is installed in an inside of a freezer chamber of a refrigerator-freezer not shown which is its host apparatus, and the ice making device "U" is a device structured to automatically produce ice pieces.

The "upper and lower" in the following descriptions means a direction parallel to the "Z"-axis of coordinate axes shown in respective drawings, and the "Z1" side is defined as an "upper" side and the "Z2" side is defined as a "lower" side. The "front and rear" means a direction parallel to the "X"-axis of the coordinate axes, and the "X1" side is defined as a "front" side and the "X2" side is defined as a "rear" side. Similarly, the "right and left" means a direction parallel to the "Y"-axis of the coordinate axes, and the "Y1" side is defined as a "right" side and the "Y2" side is defined as a "left" side. Further, the "horizontal" means a direction of the "X-Y" plane shown by the coordinate axes.

(Schematic Structure)

Figure 1:
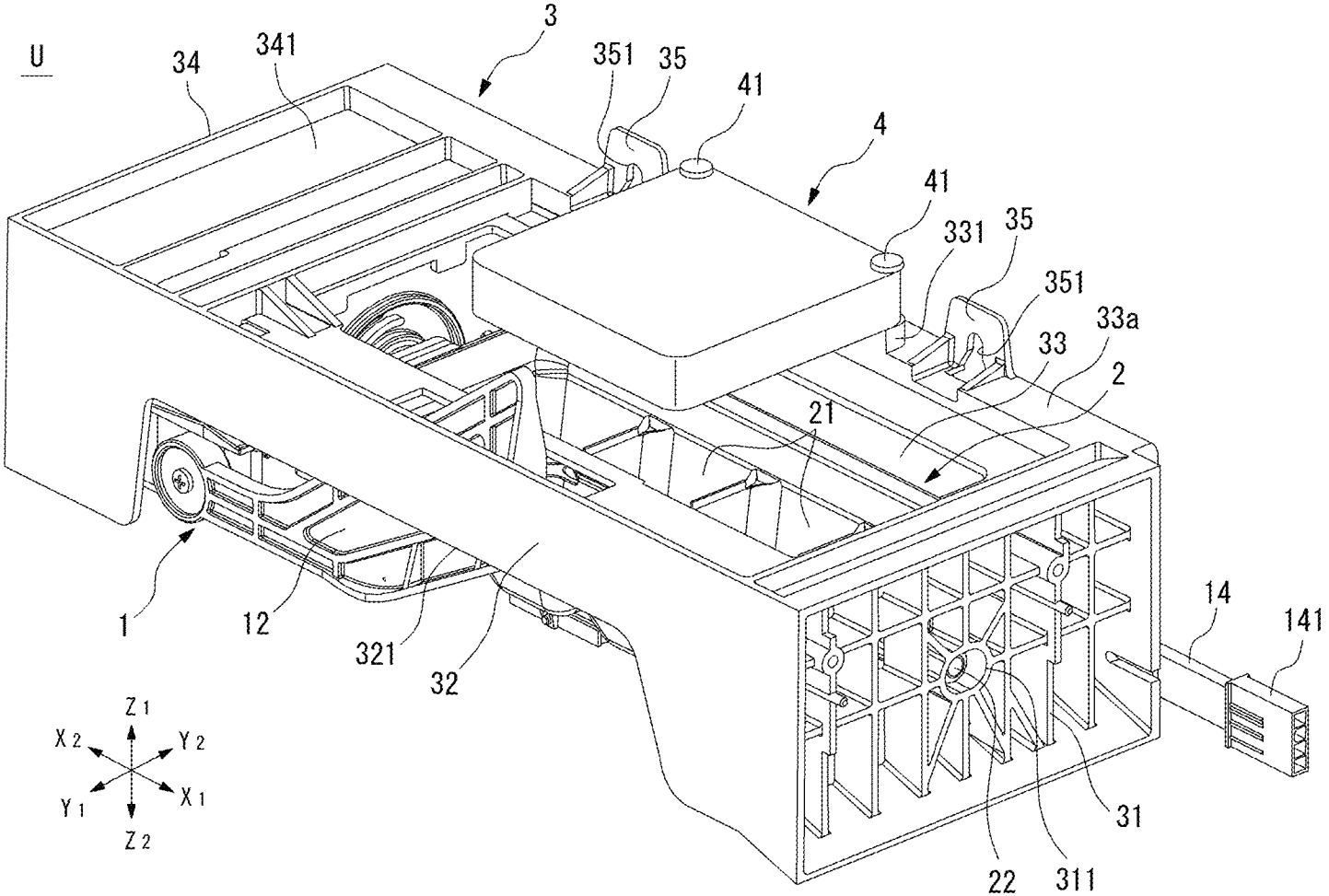
FIG. 1 is a perspective view showing an outward appearance of an ice making device in accordance with an embodiment of the present invention.
Figure 2:
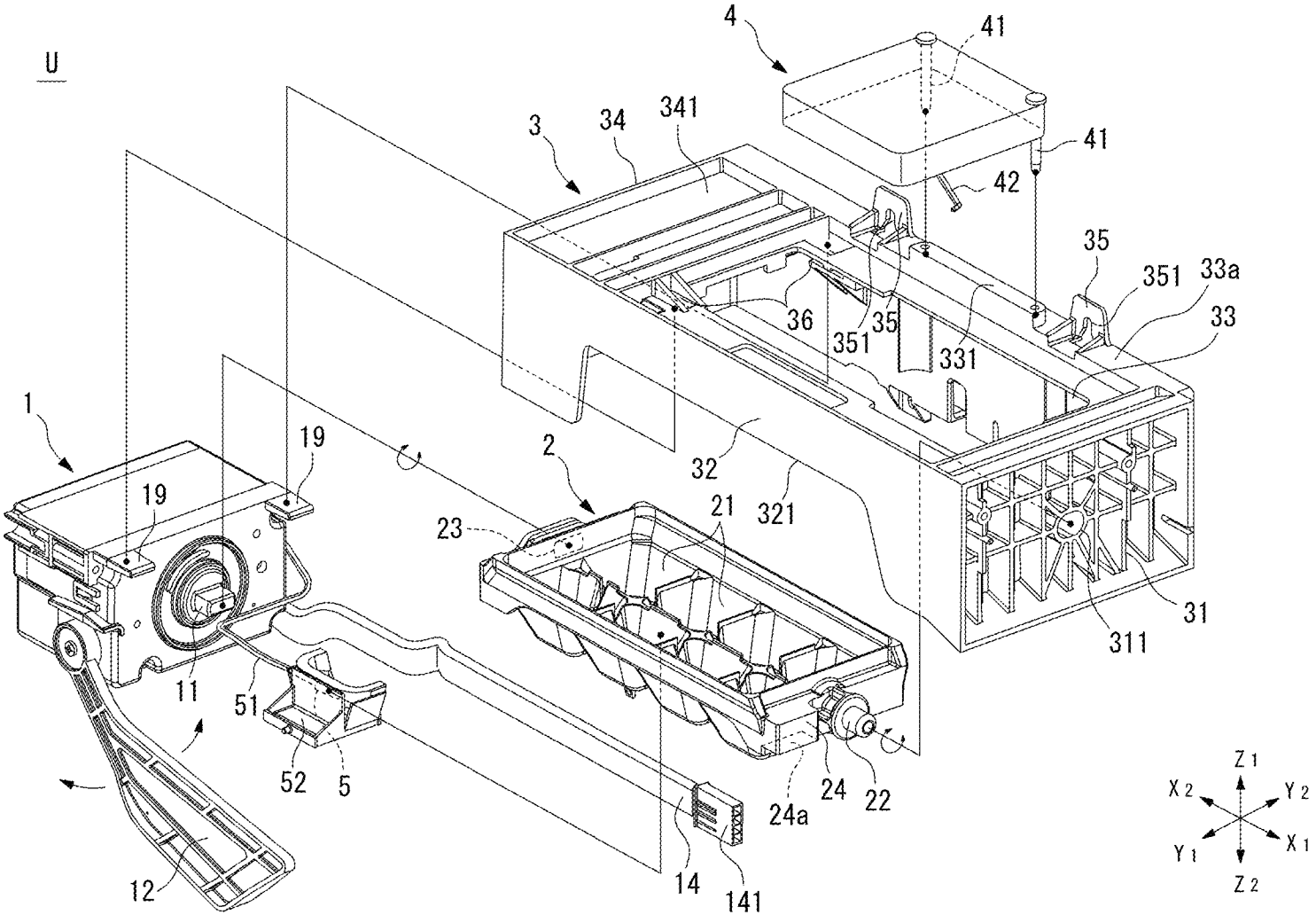
FIG. 2 is an exploded perspective view showing the ice making device.

FIG. 1 is a perspective view showing an outward appearance of an ice making device "U". FIG. 2 is an exploded perspective view showing the ice making device "U". The ice making device "U" is mainly structured of an ice tray 2, a drive unit 1 structured to turn the ice tray 2, a frame 3 which supports the ice tray 2 and the drive unit 1, and a fan motor 4 which is fixed to an upper face of the frame 3.

The ice making device "U" is a so-called "twist type" ice making device. In a freezer chamber in which the ice making device "U" is installed, an ice storage container not shown is disposed under the ice making device "U". The ice making device "U" takes out ice pieces from the ice tray 2 by twisting the ice tray 2 to drop them into the ice storage container. In the following descriptions, an operation for taking out ice pieces from the ice tray 2 is referred to as an "ice separating operation", and a mechanism structured to take out ice pieces from the ice tray 2 is referred to as an "ice separating mechanism". As described in detail below, the ice separating mechanism in this embodiment is structured of a drive unit 1 which is a drive part, a protruded part 24 of the ice tray 2, and a block part 312*a* (see FIGS. 5A and 5B) which is provided in the frame 3.

Figure 3:
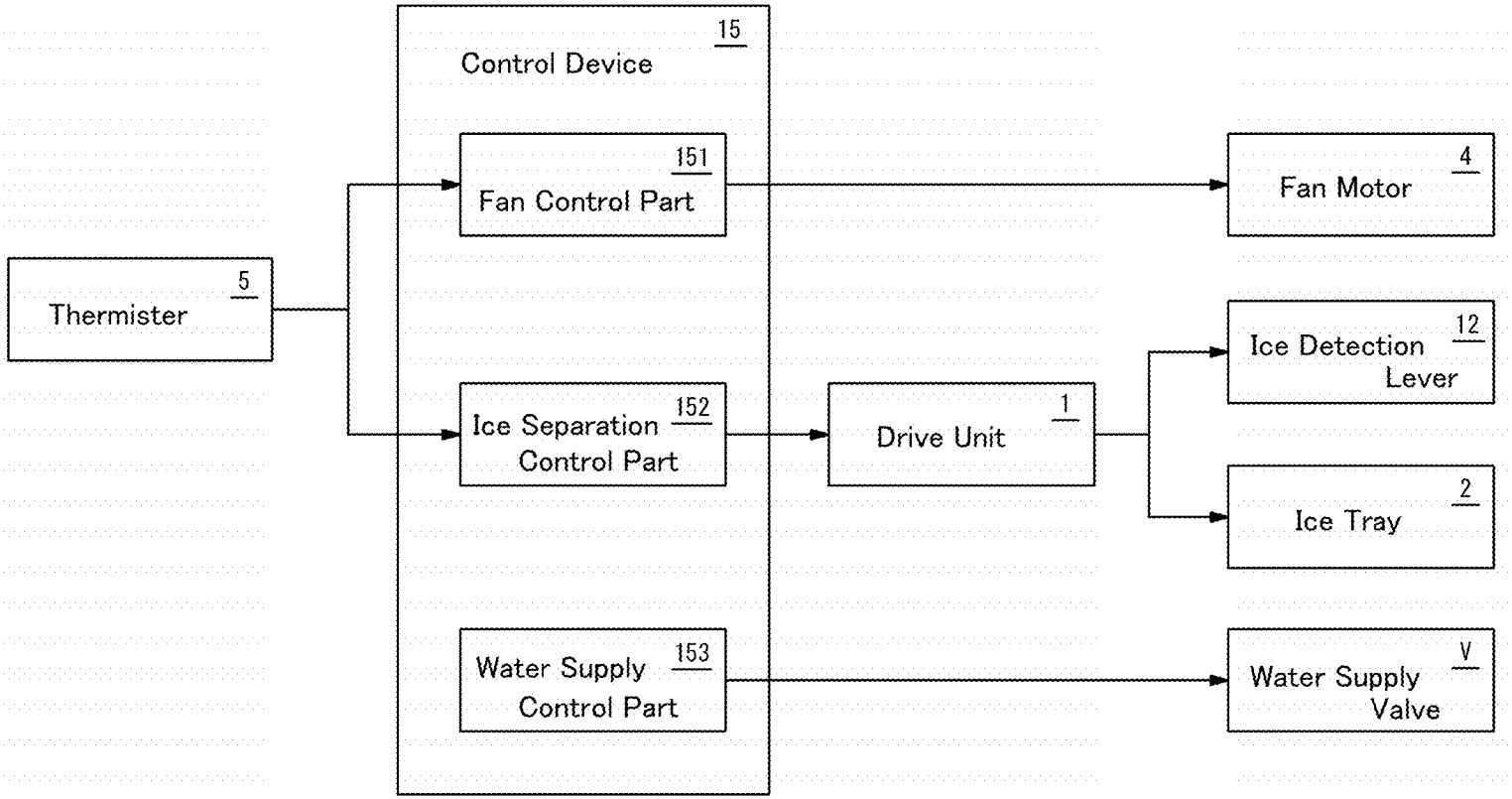
FIG. 3 is a block diagram showing a functional configuration of a control device which is a control part of the ice making device.

FIG. 3 is a block diagram showing a functional configuration of a control device 15 which is a control part of the ice making device "U". The control device 15 in this embodiment is disposed in an inside of a case of the drive unit 1. The control device 15 controls operations of the drive unit 1 and the fan motor 4 and an operation of a water supply valve "V" which is a water supply mechanism structured to open and close a water supply passage for supplying water to the ice tray 2. As a result, the ice making device "U" is capable of performing a series of operations from water supply to ice separation independently from a host apparatus.

(Drive Unit)

Next, the drive unit 1 will be described below with reference to FIG. 2. The drive unit 1 is a motor unit having a motor which is a drive source. A power feeding cable 14 is extended from a side face on the left side ("Y2" side) of the drive unit 1, and a connector 141 of the power feeding cable 14 is connected with power lines which are wired in an inside of a freezer chamber.

A front face of the drive unit 1 is provided with an output shaft 11, which is a shaft body fitted to a rear face of the ice tray 2, so as to be protruded to the front side. The drive unit 1 is structured to turn the ice tray 2 so that its upper and lower sides are inverted.

A side face on the right side ("Y1" side) of the drive unit 1 is attached with an ice detection arm 12 which is an arm member for inspecting an ice quantity in an inside of the ice storage container. The ice detection arm 12 is a plate-shaped member formed in a substantially fan shape when viewed from a side face which is gradually widened in the upper and lower direction from its base end part toward the tip end. The base end part of the ice detection arm 12 is connected with the drive unit 1, and the drive unit 1 turns the ice detection arm 12 in the upper and lower direction with the base end part of the ice detection arm 12 as a center. The drive unit 1 is structured so that, when an ice separating operation is started, the ice detection arm 12 is lowered into an inside of the ice storage container before ice pieces are taken out from the ice tray 2 to inspect an ice quantity in the inside of the ice storage container, and the drive unit 1 turns the ice tray 2 after it is confirmed that a spatial margin is present in a space of the ice storage container.

Fitting pieces 19 which are protruded parts in a flat plate shape are protruded to the front side from both ends on the right and left sides of an upper face of the drive unit 1. The frame 3 is provided with fitted slots 36 which are recessed parts corresponding to a shape of the fitting piece 19. The drive unit 1 is fixed to a rear end portion of the frame 3 by inserting the fitting pieces 19 into the fitted slots 36 of the frame 3.

Further, as also described above, the control device 15 in this embodiment is disposed in an inside of a case of the drive unit 1. The case of the drive unit 1 is utilized for protecting the control device 15 and thus, in comparison with a structure that a case body accommodating the control device 15 is separately prepared, a structure of the ice making device "U" is simplified.

(Ice Tray)

Next, the ice tray 2 will be described below with reference to FIG. 2. The ice tray 2 in this embodiment is a water storage container made of resin which is elastically deformable.

A water storage part of the ice tray 2 is divided into a plurality of cells 21. Each cell 21 is formed with slits which communicate with spaces of the adjacent cells 21 in the front and rear direction or in the right and left direction and, as a result, water supplied to a part of the cells 21 is uniformly spread to all the cells 21.

A rear face of the ice tray 2 is formed with a shaft hole 23 having the same shape as the output shaft 11 of the drive unit 1. When the output shaft 11 is fitted to the shaft hole 23, the ice tray 2 is turned interlocking with turning of the output shaft 11. A front face of the ice tray 2 is provided with a shaft part 22 which is a shaft body protruded toward the front side, and the shaft part 22 is turnably supported by a bearing part 311 formed in the frame 3.

Further, a front end of a half body on the right side ("Y1" side) of the ice tray 2 is provided with a protruded part 24 which is protruded to a front side with respect to the cell 21. The protruded part 24 is a part of the ice separating mechanism in this embodiment.

Further, a bottom face of the ice tray 2 is disposed with a thermistor 5 which is a temperature sensor for acquiring temperature of the ice tray 2. The thermistor 5 is attached to the bottom face of the ice tray 2 by using a sensor cover 52, and a lead wire 51 of the thermistor 5 is connected with the control device 15 in the inside of the drive unit 1.

(Control Part)

As shown in FIG. 3, the control device 15 in this embodiment includes a fan control part 151 configured to control driving of the fan motor 4, an ice separation control part 152 configured to control driving of the ice detection lever 12 and the ice tray 2 (output shaft 11 of the drive unit 1) through the drive unit 1, and a water supply control part 153 configured to open and close the water supply valve "V".

The control device 15 includes the ice separation control part 152 and the water supply control part 153 and thus, a series of operations from water supply to the ice tray 2 to ice separation can be autonomously performed. Further, the ice separation control part 152 performs an ice separating operation based on a detection value of the thermistor 5. As a result, for example, in comparison with a case that a series of the ice making operations is performed with a time period as a reference, ice pieces with a high degree of quality can be more efficiently and stably produced. In addition, the control device 15 in this embodiment includes the fan control part 151 and is capable of finely adjusting a start and a stop of the fan motor 4 based on the detection value of the thermistor 5.

In this embodiment, a hardware configuration of the control device 15 is not specifically limited when the above-mentioned respective functions can be realized. For example, one or a plurality of circuit boards, an FPGA, a CPLD, a microcontroller and the like can be used in the control device 15.

(Frame)

Figure 4:
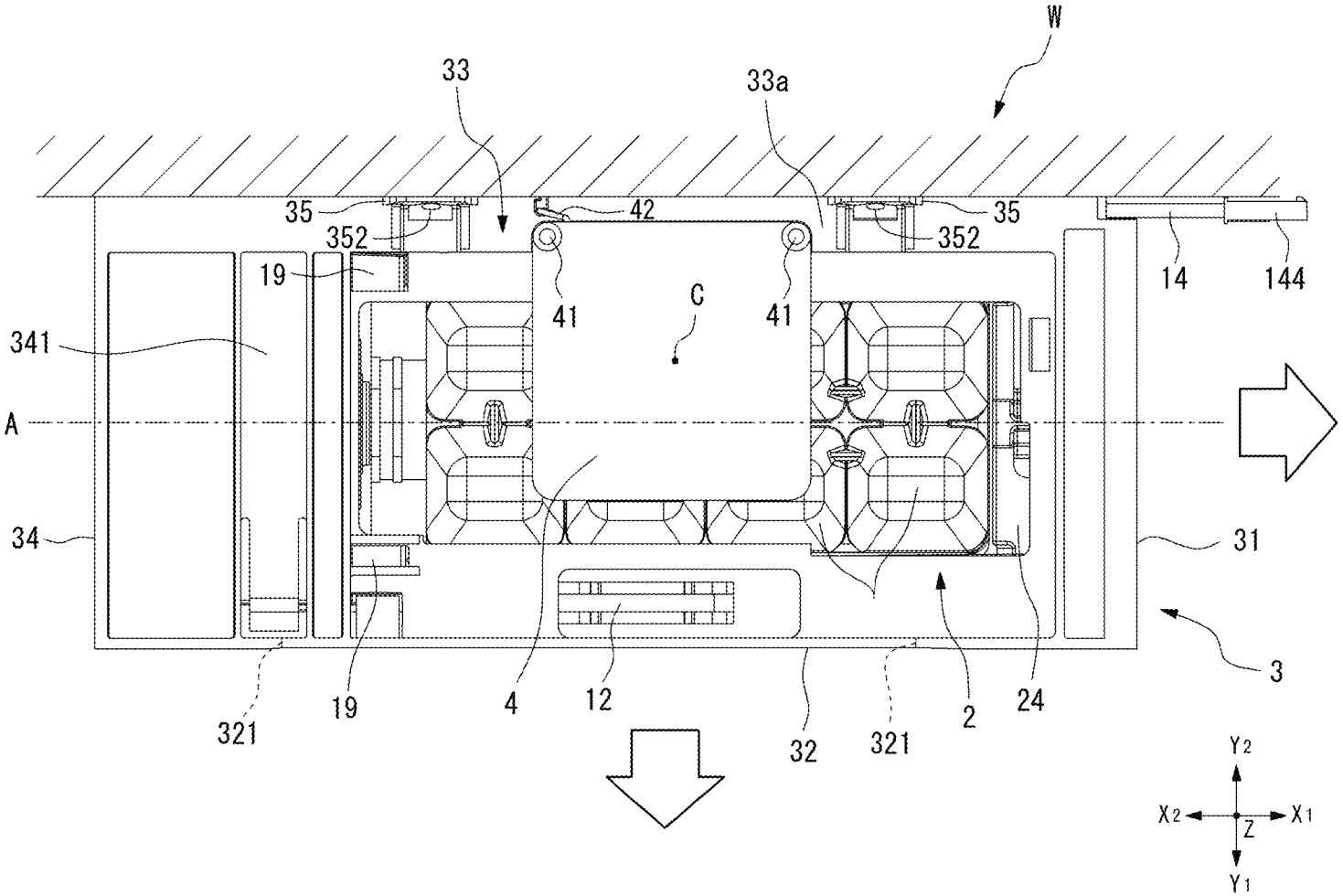
FIG. 4 is a plan view showing the ice making device.

FIG. 4 is a plan view showing the ice making device "U". Next, a structure of the frame 3 in this embodiment will be described below with reference to FIG. 1, FIG. 2 and FIG. 4.

The frame 3 is a frame body made of resin which supports the drive unit 1 and the control device 15 incorporated into the drive unit 1, the ice tray 2 and the fan motor 4. The frame 3 in this embodiment is provided with a front plate part 31, a right plate part 32 (second frame part), a left plate part 33 (first frame part) and a rear plate part 34 which are plate-shaped frame parts surrounding four sides of the ice tray 2, and these frame parts are structured so that the respective sides are formed in a substantially rectangular shape in a plan view of the frame 3.

The front plate part 31 is a frame part structuring a front face of the frame 3. The front plate part 31 is a wall part which is provided with hollow portions in a lattice shape and is formed so that its plate thickness is larger than other frame parts. The bearing part 311 which supports the shaft part 22 of the ice tray 2 is formed at a center of the front plate part 31 in a front view. As described in detail below, a rear face of the front plate part 31 is integrally formed with a block part 312*a* which is structured so as to contact with the protruded part 24 of the ice tray 2 at a time of an ice separating operation to partly prevent turning of the ice tray 2.

The right plate part 32 is a frame part structuring a right face of the frame 3. The right plate part 32 is a thin flat plate part and structures one of long sides in a plan view of the frame 3. A lower side of the right plate part 32 is provided with a cut-out part 321. The cut-out part 321 is formed over a range that a substantially entire length of the ice tray 2 can be visually recognized when the ice making device "U" is viewed in the "Y2" direction and thus, air from the fan motor 4 is capable of being flowed through the cut-out part 321 in the horizontal direction.

The left plate part 33 is a frame part structuring a left face of the frame 3. The left plate part 33 structures the other of the long sides in the plan view of the frame 3. An upper end of the left plate part 33 is provided with a horizontal face (upper face 33*a*) having an area larger than that of the right plate part 32, and the fan motor 4 is fixed to the upper face 33*a*. Further, the upper face 33*a* of the left plate part 33 is provided with two attaching parts 35 for fixing the ice making device "U" to a wall face "W" of the freezer chamber with screws 352. The right plate part 32 and the left plate part 33 structuring the long sides in the plan view of the frame 3 are easily deformed in comparison with the front plate part 31 and the rear plate part 34 structuring the short sides. In this embodiment, the attaching parts 35 of the left frame part 33 structuring one of the long sides are fixed to the wall face "W" of the freezer chamber and thereby, a deforming amount of the entire frame 3 is suppressed to be small. In accordance with an embodiment of the present invention, an object with which the attaching parts 351 are joined is not limited to the wall face "W" of the freezer chamber and may be, for example, other portions in the freezer chamber or other members disposed in the freezer chamber. In addition, a pedestal part 331 which is a thick wall part formed between the two attaching parts 35 of the left plate part 33 is provided so that a height of its upper face 33*a* is protruded with respect to other portions, and the fan motor 4 is fixed to the pedestal part 331 with screws 41.

The rear plate part 34 is a frame part structuring a rear face of the frame 3. The rear plate part 34 covers a rear face of the drive unit 1, and a rear end portion of the frame 3 is provided with a top plate part 341 which covers an upper face of the drive unit 1. The top plate part 341 is continuously formed with an upper end of the rear plate part 34 and with upper ends of the right plate part 32 and the left plate part 33 in the vicinity of the rear plate part 34.

The frame 3 in this embodiment is a frame body having four plate-shaped frame parts in a substantially rectangular shape in a plan view. However, the shape of the frame 3 may be, for example, a substantially triangular shape in a plan view, or a substantially polygonal shape such as a pentagon or with more sides. Further, the frame part structuring the respective sides surrounding a periphery of the ice tray 2 is not limited to a straight line shape in a plan view, and a frame part formed in a circular arc shape may be included.

(Ice Separating Operation)

Figure 5A:
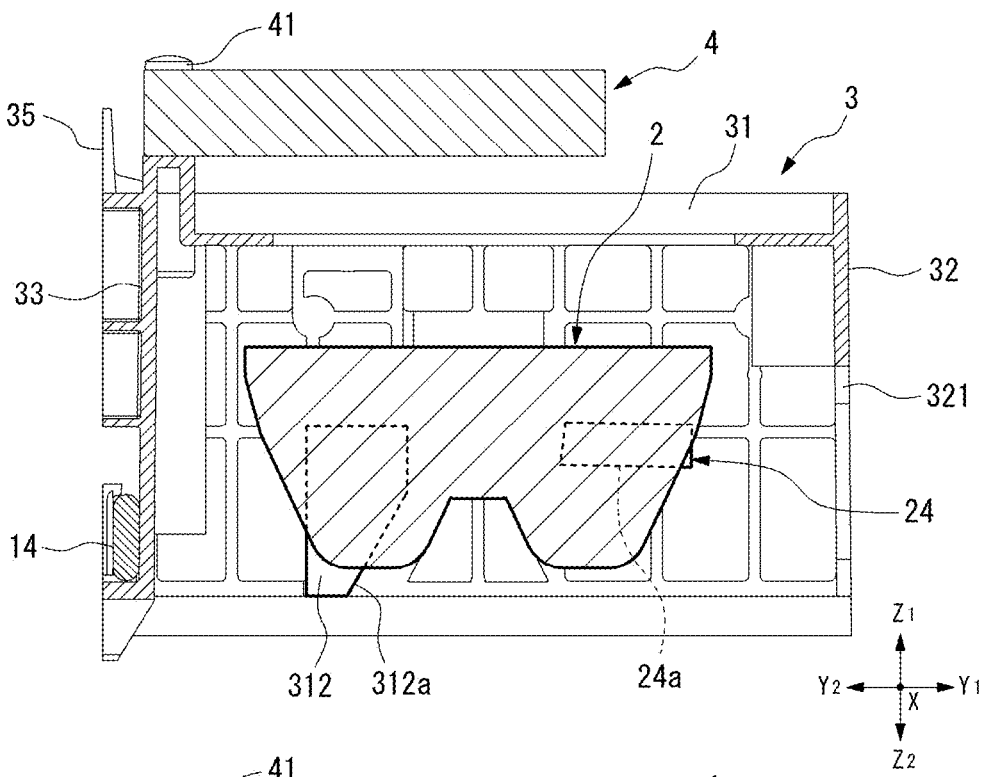
FIGS. 5A and 5B are explanatory cross-sectional views showing an ice separating operation of the ice making device which are viewed from a rear face side.
Figure 5B:
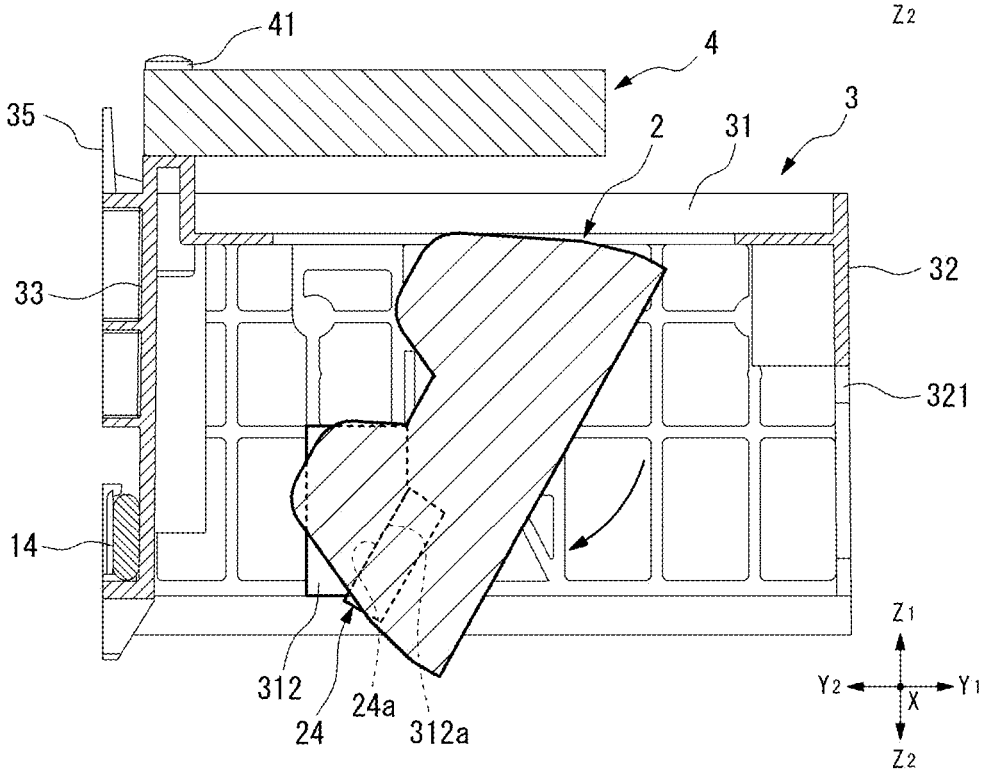

FIGS. 5A and 5B are explanatory cross-sectional views showing an ice separating operation of the ice making device "U" which are viewed from a rear face side. FIG. 5A is a view showing a state that the ice tray 2 is horizontally disposed, and FIG. 5B is a view showing an arrangement of the ice tray 2 when the ice separating operation is performed.

The front plate part 31 of the frame 3 is integrally provided with a solid rib 312 on a rear side of the wall part which is provided with hollow portions in a lattice shape. The rib 312 is provided with a block part 312*a* which is a face structured to contact with a bottom face 24*a* of the protruded part 24 of the ice tray 2 being turned and partly prevent turning of the ice tray 2. The ice separating mechanism in this embodiment is structured of the drive unit 1 for turning the ice tray 2, the protruded part 24 and the block part 312*a*.

The ice separation control part 152 of the control device 15 is structured so that, when the temperature of the ice tray 2 has reached −10° and it is detected that ice pieces have been produced, the drive unit 1 is operated so as to start an ice separating operation. The ice separation control part 152 inspects an ice quantity by lowering the ice detection arm 12 to an inside of the ice storage container before turning the ice tray 2 and, after having confirmed that the ice storage container has a spatial margin, the ice separation control part 152 turns the ice tray 2 in a clockwise direction in FIG. 5A.

When the ice tray 2 is turned by a predetermined amount, the bottom face 24*a* of the protruded part 24 is contacted with the block part 312*a*. The ice separation control part 152 further turns the ice tray 2 from this state and deforms so as to twist the ice tray 2. As a result, ice pieces of the ice tray 2 are pushed out from the respective cells 21 and drop into the ice storage container which is disposed under the ice making device "U".

After the ice pieces have been taken out from the ice tray 2, the ice separation control part 152 turns the ice tray 2 in a counterclockwise direction in FIG. 5B to return the ice tray 2 to a horizontal arrangement. When the control device 15 detects that a series of the ice separating operations has been completed, the control device 15 opens the water supply valve "V" through the water supply control part 153 to fill the ice tray 2 with water again.

(Fan Motor and its Fixing Structure)

The fan motor 4 in this embodiment is a general blower in which blades (fan) are integrated with a motor. A fixing structure of the fan motor 4 will be described below with reference to FIG. 1, FIG. 2 and FIG. 4.

The fan motor 4 in this embodiment includes a case body whose outer peripheral shape in a plan view is a substantially square shape, and only an end part structuring one side is fixed to the left plate part 33 with the screws 41. Although not shown in the drawing, the fan motor 4 includes an air passage which penetrates through in the thickness direction (upper and lower direction), and the fan incorporated into the fan motor 4 sucks air from an opening of an upper face of the fan motor 4 and exhausts it from an opening of its lower face. In other words, the fan motor 4 sends air toward a lower side.

The ice tray 2 in this embodiment is a water storage container which is made of resin. Different from an ice tray made of metal, the ice tray 2 made of resin acts like heat insulating material. Therefore, it is inefficient to blow air of the fan motor 4 toward the ice tray 2 from an under side with respect to the ice tray 2. According to this embodiment, air is blown to the ice tray 2 from an upper side with respect to the ice tray 2, in other words, air of the fan motor 4 is directly blown to water in the ice tray 2 and thus, heat of solidification can be smoothly released from the water in the ice tray 2.

The fan motor 4 in this embodiment is fixed to only the left plate part 33. A "fixing part" in the following descriptions is, for example, a portion that the fan motor 4 and the pedestal part 331 are joined with each other so as to be relatively immovable, such as threaded hole portions of the fan motor 4 and the pedestal part 331 which are fixed with the screw 41. Further, a "fixing face" is a common face of the frame 3 in which a plurality of fixing parts are arranged, for example, an upper face of the pedestal part 331.

When the ice separating operation is started and the protruded part 24 of the ice tray 2 is pressed against the block part 312*a* of the front plate part 31, the frame 3 which is a frame body made of resin is deformed so that its outer shape is twisted. In this case, when the fan motor 4 is fixed astride to a plurality of the frame parts structuring the frame 3, displacement directions and displacing amounts of the frame parts are different from each other and thus, the fixing face of the fan motor 4 is distorted. In the ice making device "U" in this embodiment, the fixing part of the fan motor 4 is provided only in one frame part (left plate part 33) structuring the frame 3 and thus, distortion of the fixing face of the fan motor 4 is suppressed to be small and looseness and damage of the fixing part of the fan motor 4 are restrained.

In addition, in the ice making device "U" in this embodiment, the fan motor 4 is fixed to the pedestal part 331 whose wall thickness in the upper and lower direction is formed larger than other portions in the upper face 33*a* of the left plate part 33. The thickness of the fixing face of the fan motor 4 is formed thick and rigidity of the portion is increased and thus, even when the left plate part 33 is deformed, distortion of the fixing face of the fan motor 4 is suppressed to be small.

Further, also as described above, the upper face 33*a* of the left plate part 33 is provided with two attaching parts 351 for fixing the ice making device "U" to the wall face "W" of the freezer chamber with the screws 352. The attaching parts 351 provided in the left plate part 33 are fixed to the wall face "W" in an inside of the freezer chamber so as to be immovable and thus, deformation of the left plate part 33 is restricted. Further, the pedestal part 331 is provided between the two attaching parts 351. In a portion between the two attaching parts 351, transmission of distortion is blocked by the attaching parts 351 and thus, the deforming amount is especially small. As described above, in the ice making device "U" in this embodiment, the fan motor 4 is fixed only to the pedestal part 331 having a large thickness which is provided between the two attaching parts 351 and thus, influence on the fan motor 4 due to distortion of the frame 3 at a time of ice separation is suppressed to be small.

Further, as shown in FIG. 4, the rotation center "C" of the fan motor 4 is located at a position shifted to the left plate part 33 side with respect to the center position "A" between the right plate part 32 and the left plate part 33 in a plan view of the frame 3. When the attaching parts 351 of the left plate part 33 are fixed to the wall face "W" of the freezer chamber with the screws 352, an air passage on the left plate part 33 side is restricted by the wall face "W" of the freezer chamber and its air pressure becomes higher than those on the right plate part 32 side and the front plate part 31 side where such restriction is not provided. In other words, air of the fan motor 4 is hard to flow to the left plate part 33 side. Therefore, the fan motor 4 is previously disposed at a position shifted to the left plate part 33 side and an air passage is set so that air of the fan motor 4 flows from the left plate part 33 side to the other side and thus, stagnation of air on the left plate part 33 side is prevented and heat of solidification can be released smoothly.

In this embodiment, air of the fan motor 4 is hard to flow to the rear plate part 34 side where the drive unit 1 is disposed. Therefore, the rotation center "C" of the fan motor 4 is disposed on a rear side with respect to the center position in an axial line direction of the ice tray 2. Further, the right plate part 32 in this embodiment is provided with the cut-out part 321 and the front plate part 31 is provided with hollow portions in a lattice shape. As a result, air of the fan motor 4 is induced to the right plate part 32 side and to the front plate part 31 side and thus, flow of the air is prevented from stagnating on the left plate part 33 side and the rear plate part 34 side.

(Drive Control of Fan Motor)

Figure 6:
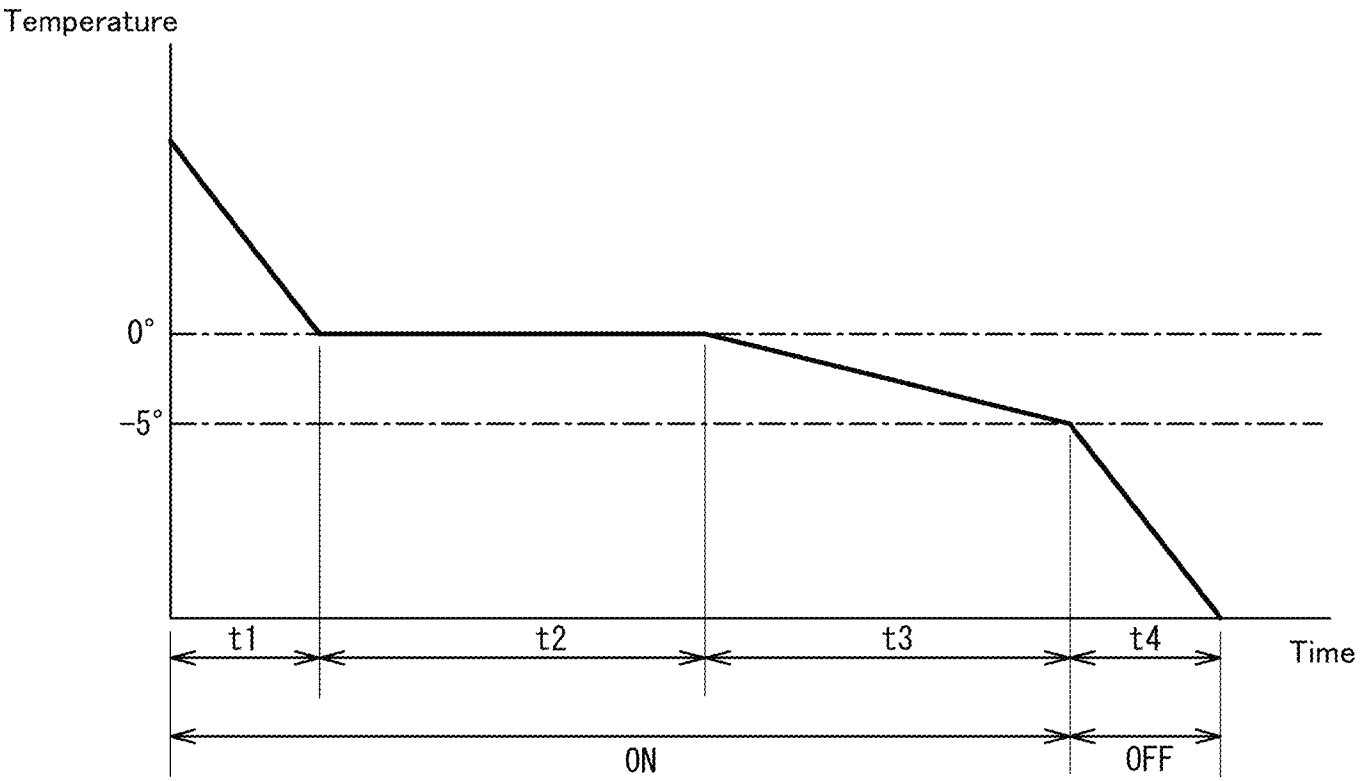
FIG. 6 is a graph showing a control method for a fan motor by a control device.

FIG. 6 is a graph showing a control method for the fan motor 4 by the control device 15.

The fan control part 151 of the control device 15 drives the fan motor 4 until temperature of the ice tray 2 becomes −5° after water has been supplied to the ice tray 2. Further, the ice separation control part 152 of the control device 15 starts an ice separating operation when the temperature of the ice tray 2 becomes −10°.

Temperature change of the water which is supplied to the ice tray 2 may be divided, after the water is supplied, into a process (t1) until the water temperature becomes 0°, a process (t2) in which the water temperature is maintained in the vicinity of 0° and heat of solidification is generated, and processes (t3 and t4) in which the water temperature is gradually changed from 0° to a minus temperature.

Heat transfer of the water which is supplied to the ice tray 2 is, after the water has been supplied, mainly performed during a time when the water temperature becomes 0° at which the water is changed into a state of ice and about 0° (t1-t3). In other words, the fan motor 4 is driven only during a time when air sent by the fan motor 4 is effective and thus, while an ice-making capacity of the ice making device "U" is maintained, power saving of the ice making device "U" can be attained. The fan control part 151 in this embodiment starts driving of the fan motor 4 after the water is supplied to the ice tray 2 and stops the driving when the temperature of the ice tray 2 becomes −5°. After that, the ice separation control part 152 starts an ice separating operation when the temperature of the ice tray 2 becomes −10°. However, the setting of the temperature in this embodiment is one example. The temperature at which the fan motor 4 is stopped may be set not more than 0°, and further, a start temperature of the ice separating operation may be the same as the temperature that the fan motor 4 is stopped. Further, driving of the fan motor 4 is not required to start immediately after water is supplied to the ice tray 2, and the fan motor 4 may be driven with a lapse of a predetermined time period after water is supplied to the ice tray 2.

Although the present invention has been shown and described with reference to a specific embodiment, various changes and modifications will be apparent to those skilled in the art from the teachings herein.

What is claimed is:

1. An ice making device, comprising:

an ice tray;

a fan motor configured to send air to the ice tray;

an ice separating mechanism including a drive unit, the drive unit including a motor as a drive source and configured to turn the ice tray to cause upper and lower sides of the ice tray to be inverted to take out ice pieces from the ice tray;

a control part configured to control operations of the fan motor, the ice separating mechanism, and a water supply mechanism configured to open and close a water supply passage for supplying water to the ice tray; and a frame which holds the ice tray, the fan motor, the ice separating mechanism, and the control part;

wherein the fan motor is fixed to only a first frame part which is one of a plurality of frame parts structuring respective sides surrounding a periphery of the ice tray in a plan view of the frame, the frame includes a second frame part which is another of the plurality of the frame parts, the second frame part facing the first frame part with the ice tray interposed therebetween, and a rotation center of the fan motor is located at a position which is shifted to a side of the first frame part with respect to a center position between the first frame part and the second frame part in the plan view of the frame.

2. The ice making device according to claim 1, further comprising a temperature sensor configured to acquire a temperature of the ice tray, wherein the control part is configured to control the operations of the ice separating mechanism and the fan motor based on a detection value of the temperature sensor.

3. The ice making device according to claim 2, wherein the control part is configured to drive the fan motor until the temperature of the ice tray becomes a predetermined temperature equal to or lower than 0° after the water has been supplied to the ice tray, and the predetermined temperature is same as or higher than a temperature at which driving of the ice separating mechanism is started.

4. The ice making device according to claim 1, wherein the control part is disposed in an inside of a case of the drive unit.

5. The ice making device according to claim 4, wherein the frame comprises a block part which is in contact with a part of the ice tray during turning of the ice tray to partially disturb the turning of the ice tray.

6. The ice making device according to claim 1, wherein the frame comprises an attaching part configured to fix the ice making device in an inside of a freezer chamber, and the attaching part is provided in the first frame part.

7. The ice making device according to claim 1, wherein the frame comprises a plurality of attaching parts configured to fix the ice making device in an inside of a freezer chamber, the first frame part comprises the plurality of attaching parts, and the fan motor is fixed between one of the plurality of attaching parts and another of the plurality of attaching parts.

8. The ice making device according to claim 6, wherein an outer peripheral shape of the frame in the plan view of the frame is substantially rectangular, and the first frame part structures one of long sides of the frame in the plan view.

9. The ice making device according to claim 1, wherein the second frame part is a plate-shaped frame part, and the second frame part comprises a cut-out part through which air from the fan motor is capable of flowing in a horizontal direction.

10. The ice making device according to claim 1, wherein the first frame part comprises a pedestal part, a thickness of the pedestal part in an upper and lower direction is larger than a remainder of the first frame part, and the fan motor is fixed to the pedestal part.

11. The ice making device according to claim 1, wherein the ice tray is made of resin, and the fan motor is configured to send air to the ice tray from the upper side of the ice tray.

12. The ice making device according to claim 1, wherein an outer peripheral shape of the fan motor in a plan view of the fan motor is substantially square, and only an end part structuring one side of the fan motor is fixed to the first frame part in the plan view of the fan motor.

13. An ice making device, comprising:

an ice tray;

a fan motor configured to send air to the ice tray;

an ice separating mechanism including a drive unit, the drive unit including a motor as a drive source and configured to turn the ice tray to cause upper and lower sides of the ice tray to be inverted to take out ice pieces from the ice tray;

a control part configured to control operations of the fan motor, the ice separating mechanism, and a water supply mechanism configured to open and close a water supply passage for supplying water to the ice tray; and a frame which holds the ice tray, the fan motor, the ice separating mechanism, and the control part, wherein an outer peripheral shape of the frame in a plan view of the frame is substantially rectangular, the frame includes a first frame part which is one of a plurality of frame parts structuring respective sides surrounding a periphery of the ice tray in the plan view of the frame and is one of long sides of the frame in the plan view; and a second frame part which is another of the plurality of the frame parts, the second frame part facing the first frame part with the ice tray interposed therebetween, the first frame part includes an upper face having an area larger than an area of the second frame part, the first frame part includes a pedestal part at the upper face, a thickness of the pedestal part in an upper and lower direction being larger than a remainder of the first frame part, and the fan motor is fixed to only the first frame part by a screw fixing the fan motor to the pedestal part.

14. The ice making device according to claim 13, further comprising a temperature sensor configured to acquire a temperature of the ice tray, wherein the control part is configured to control the operations of the ice separating mechanism and the fan motor based on a detection value of the temperature sensor.

15. The ice making device according to claim 13, wherein the control part is disposed in an inside of a case of the drive unit.

16. The ice making device according to claim 13, wherein the frame comprises an attaching part configured to fix the ice making device in an inside of a freezer chamber, and the attaching part is provided in the first frame part.

17. The ice making device according to claim 16, wherein the frame comprises a plurality of attaching parts configured to fix the ice making device in an inside of a freezer chamber, the first frame part comprises the plurality of attaching parts, and the fan motor is fixed between one of the plurality of attaching parts and another of the plurality of attaching parts.

18. The ice making device according to claim 13, wherein a rotation center of the fan motor is located at a position which is shifted to a side of the first frame part with respect to a center position between the first frame part and the second frame part in the plan view of the frame.

19. The ice making device according to claim 13, wherein the second frame part is a plate-shaped frame part, and the second frame part comprises a cut-out part through which air from the fan motor is capable of flowing in a horizontal direction.

* * * * *